US007467840B2

(12) United States Patent
Dijksman et al.

(10) Patent No.: US 7,467,840 B2
(45) Date of Patent: Dec. 23, 2008

(54) METHOD FOR ACCURATELY CONTROLLING THE VOLUME OF INK DROPLETS EMITTED FROM A PRINT HEAD

(75) Inventors: Johan Frederik Dijksman, Eindhoven (NL); Steven Ferdinand Kleijer, Eindhoven (NL)

(73) Assignee: TPO Displays Corp. (TW)

( * ) Notice: Subject to any disclaimer, the term of this patent is extended or adjusted under 35 U.S.C. 154(b) by 281 days.

(21) Appl. No.: 10/554,844

(22) PCT Filed: Apr. 28, 2004

(86) PCT No.: PCT/IB2004/050529

§ 371 (c)(1),
(2), (4) Date: Oct. 28, 2005

(87) PCT Pub. No.: WO2004/096551

PCT Pub. Date: Nov. 11, 2004

(65) Prior Publication Data

US 2006/0279602 A1 Dec. 14, 2006

(30) Foreign Application Priority Data

May 2, 2003 (EP) ..... 03101223

(51) Int. Cl.
*B41J 29/393* (2006.01)

(52) U.S. Cl. ..... 347/19; 347/9; 347/10

(58) Field of Classification Search ..... 347/19
See application file for complete search history.

(56) References Cited

U.S. PATENT DOCUMENTS 5,745,136 A * 4/1998 Saito ..... 347/50
6,375,299 B1 * 4/2002 Foster et al. ..... 347/19
6,478,395 B2 11/2002 Tanaka et al.
6,719,211 B2 * 4/2004 Takeuchi et al. ..... 239/102.2
6,793,311 B2 * 9/2004 Baba et al. ..... 347/19
7,287,965 B2 * 10/2007 Vogeley et al. ..... 417/413.2
2002/0057304 A1 5/2002 Akiyama et al.

FOREIGN PATENT DOCUMENTS

JP 57189858 A 11/1982

OTHER PUBLICATIONS

International Search Report PCT/IB2004/050529.

* cited by examiner

*Primary Examiner*—Matthew Luu
*Assistant Examiner*—Brian J Goldberg
(74) *Attorney, Agent, or Firm*—Venable LLP; Cameron H. Tousi

(57) ABSTRACT

A method for controlling printing actions of a print head (1) comprising pumps (10) filled with ink (18), and actuators (16) for generating actuation pulses acting on the ink(18), comprises the step of determining a characteristic frequency of the pumps (10). As the characteristic frequency of the pumps (10) is directly related to the geometry of the pumps (10), the characteristic frequency can be used as an indicator of the state of the pumps (10) and the volume of the ink droplets emitted by the pumps (10). In case a slight change of the characteristic frequency is detected, the actuation pulse is adjusted in order to still meet the requirements regarding the volume of the ink droplets. In case a relatively large change of the characteristic frequency is detected, the printing action of the pump (10) concerned is stopped, and may be taken over by another pump (10).

9 Claims, 7 Drawing Sheets

METHOD FOR ACCURATELY CONTROLLING THE VOLUME OF INK DROPLETS EMITTED FROM A PRINT HEAD

The present invention relates to a method for controlling the volume of droplets of printing fluid emitted from a print head during a printing process, said print head comprising: at least one pump having an inlet for taking in the printing fluid, a pump chamber for containing the printing fluid and an outlet for letting out the printing fluid; and an actuator for generating actuation pulses acting on the printing fluid in the pump.

Printing is a well-known technique for laying down a layer on a carrier consisting of paper, glass, plastic or another suitable material or mixture of materials. A type of printing technique in which the layer is formed by spraying a printing fluid on the carrier is commonly referred to as ink-jet printing technique.

For the purpose of carrying out the ink-jet printing technique, ink-jet printers have been developed. These printers comprise a print head in which a large number of miniature valveless pumps are integrated. Each pump is associated with an actuator for influencing the pressure of the printing fluid in the pump. When the actuator is actuated, the pressure in the pump is increased, as a result of which the pump delivers exactly one droplet of printing fluid, the droplet having a specified flight direction, speed and size. As the actuators may be controlled individually, it is possible to exactly determine when a pump needs to fire a droplet and when the same pump needs to retain the printing fluid on the basis of the characteristics of a desired printed pattern.

The concept of firing and retaining droplets of printing fluid according to a predetermined schedule is often referred to as drop-on-demand (DOD). The technology of DOD print heads has developed along two main lines, which has resulted in two main types of print heads.

A first main type of print head is a bubble-jet print head. In a bubble-jet print head, each pump contains a small heating element that is in direct contact with the printing fluid. When a droplet needs to be emitted, the heating element is switched on, as a result of which the printing fluid in contact with the heating element is quickly heated to a relatively high temperature. During the process, the heat flux is so high that during the switch-on time the heat penetrates only a thin fluid layer, causing a vapour bubble to grow almost explosively at a predetermined spot in the pump. This growing vapour bubble causes a small amount of liquid to be pushed at a high velocity through the outlet of the pump.

A second main type of print head is a piezo-jet print head. In a piezo-jet print head, each pump has its own piezo-electric actuator. When charged, the actuator deforms, causing a pressure rise in the pump that leads to droplet emission.

The present invention will be described in the context of piezo-jet printing, which does not imply that the present invention is not applicable to bubble-jet printing as well.

DOD ink-jet printing proves to be an enabling technology for the manufacturing of displays comprising a large number of light emitting diodes, which displays are commonly referred to as PolyLED displays. Each light emitting diode (commonly referred to as LED) comprises a stack of individual layers. A number of these layers is formed by dosing the material of these layers dissolved in a solvent into a pixel, a pixel being a limited area having predetermined dimensions.

For the purpose of the above-described application during the manufacturing process of PolyLED displays, the printing process has to meet very high requirements. A first requirement is that all pixels need to be printed, as the omission of a pixel will inevitably have an annoying effect on a user of the display, who will be able to perceive the omission. A second requirement is that the thickness of a certain printed layer needs to be the same for all individual pixels, as a variation in thickness will result in a variation in light intensity of the emitted light over the display. It will be understood that in order to meet the requirements, the output of the individual pumps of the print head needs to be the same, and also needs to be constant in time.

In practice, the output of the pumps of the print head changes in time, due to for example clogging which may take place near the outlet of the pump. Therefore, the output of the pumps needs to be checked regularly, resulting in the print head having to be flushed, de-aired or even replaced when the output of one or more of the pumps deviates too much from a predetermined output.

It is an objective of the present invention to provide a method for controlling the volume of droplets of printing fluid emitted from a print head, which may be applied to keep the volume of the droplets at a constant level over time.

The objective is achieved by means of a controlling method which comprises the following steps:

- determining a first characteristic frequency of the pump during a first measurement;
- actuating the actuator at least one time in order to generate an actuation pulse which causes at least one droplet of printing fluid to be emitted from the pump during a first printing action;
- determining a second characteristic frequency of the pump during a second measurement;
- comparing the second characteristic frequency to the first characteristic frequency; and
- determining the value of the actuation pulse which needs to be generated by the actuator for the purpose of causing at least one droplet of printing fluid to be emitted from the pump during a second printing action on the basis of a difference found between the first characteristic frequency and the second characteristic frequency, and on the basis of requirements regarding the volume of the droplet of printing fluid to be emitted during the second printing action.

According to the present invention, the value of the actuation pulse that is generated by the actuator is adjusted in time in order to meet the requirements regarding the volume of the droplet. In this way, changes in the geometry of the pump 10, 20 are compensated for. The required order of magnitude of the adjustment of the value of the actuation pulse is determined on the basis of these requirements, on the one hand, and a comparison of characteristic frequencies of the pump, on the other hand.

For the purpose of manufacturing PolyLED displays, the requirements regarding the volume of the droplet include keeping the volume of the droplet constant over time, as is described in the foregoing. In the case of such requirements being applicable, if the difference found between two subsequently measured characteristic frequencies is zero, it may be assumed that the value of the actuation pulse does not need to be adjusted in order for the output of the pump during a second printing action, that will be performed subsequent to the second measurement, to be the same as the output of the pump during a first printing action that is performed between the two measurements. However, if the difference found between two subsequently measured characteristic frequencies does not equal zero, the value of the actuation pulse needs to be adjusted in order to assure that the volume of droplets of printing fluid emitted during the second printing action is the same as the volume of droplets of printing fluid emitted during the first printing action.

For the purpose of the present invention, knowledge of the characteristic frequency of the pump being related to the dimensions of the pump is applied in combination with knowledge of the volume of the emitted droplet being mainly determined by the dimensions of the pump.

Using common frequency measurement techniques, determining the characteristic frequency of the pump does not require much time. The determination process may be performed so fast, that it is possible to incorporate the determination process in a printing process, without influencing the speed of the printing process. In such a case, a combined process is obtained, in which the process of controlling the pumps of the print head to fire droplets is alternated with the process of checking the output of the pumps of the print head and determining the required adjustment of the value of the actuation pulse that is generated by the actuator.

The present invention will now be explained in greater detail with reference to the Figures, in which similar parts are indicated by the same reference signs, and in which:

FIG. 1 diagrammatically shows a sectional view of a portion of a print head having Helmholtz-type ink jet pumps;

FIG. 2 diagrammatically shows a single Helmholtz-type ink jet pump;

FIG. 3 diagrammatically shows a sectional view of a portion of a print head having open-end ink jet pumps;

FIG. 4 diagrammatically shows a single open-end ink jet pump;

Figure 8:
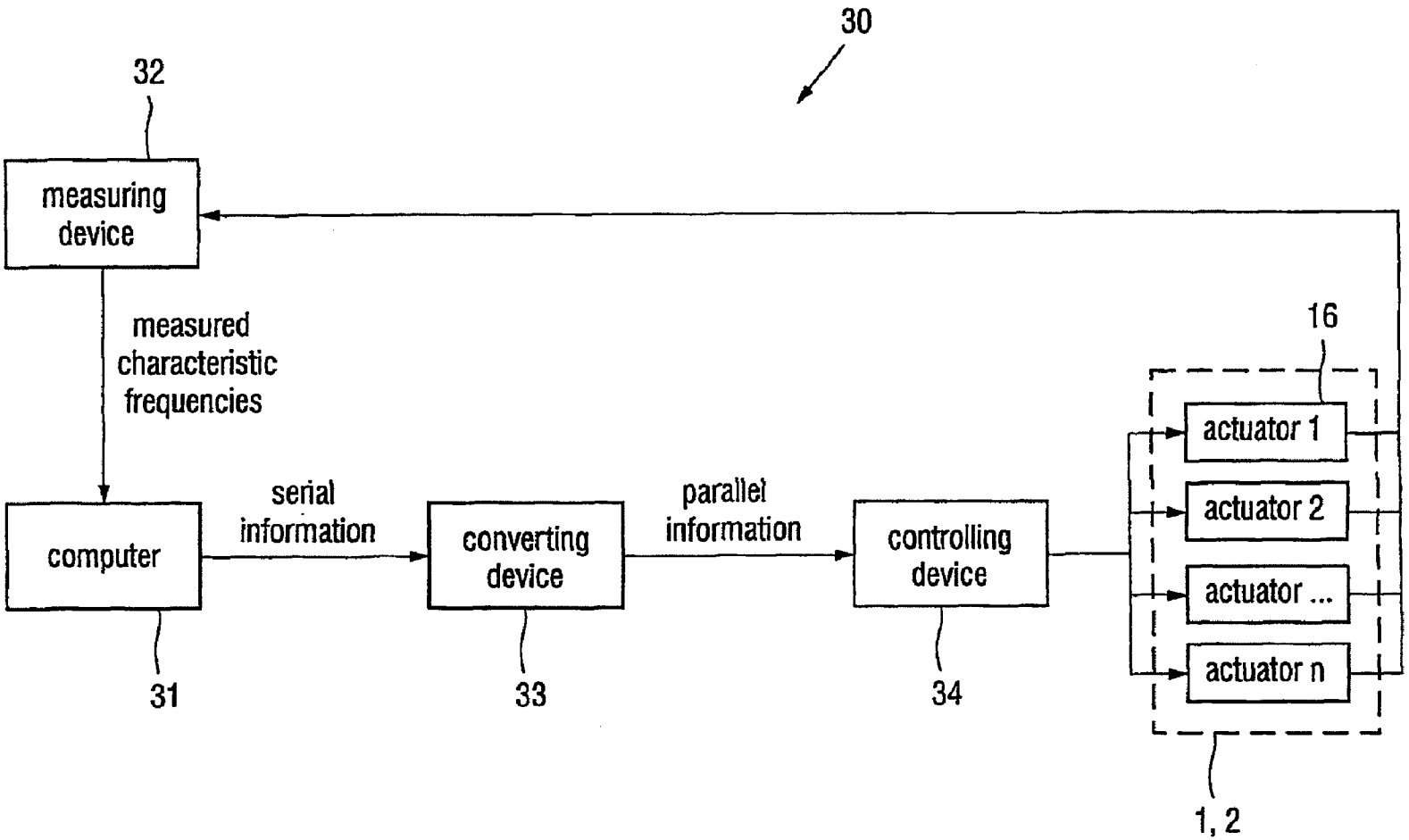
Figure 9:
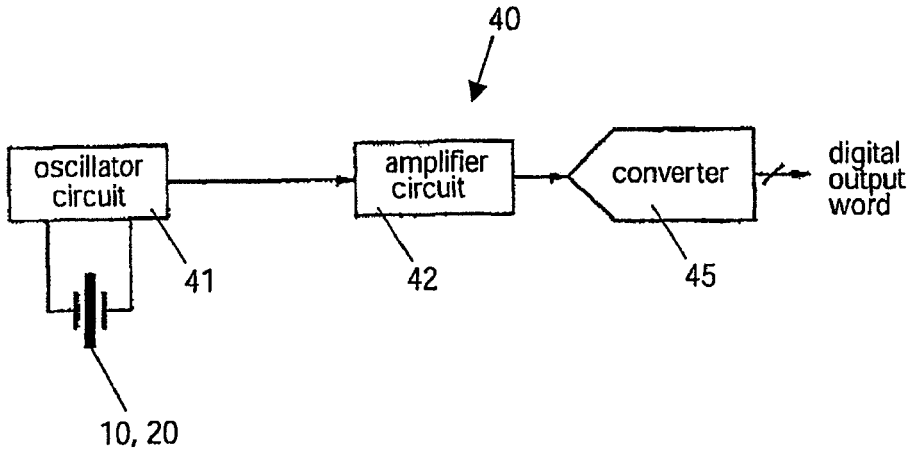
Figure 10:
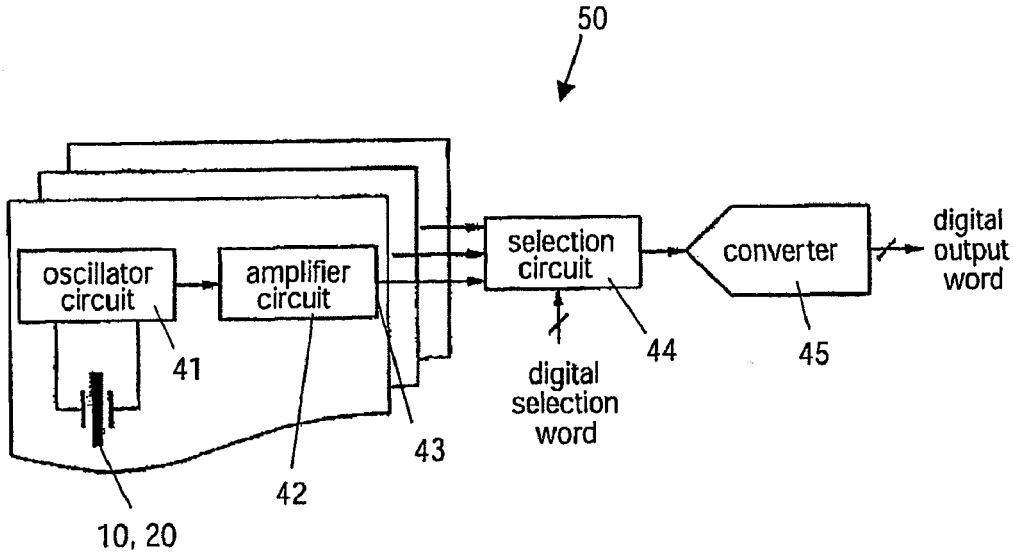

FIG. 8 diagrammatically shows a system for controlling the actions of a print head;

FIG. 9 diagrammatically shows a system for measuring a characteristic frequency of a single pump; and FIG. 10 diagrammatically shows a system for measuring characteristic frequencies of a number of pumps.

Figure 11:
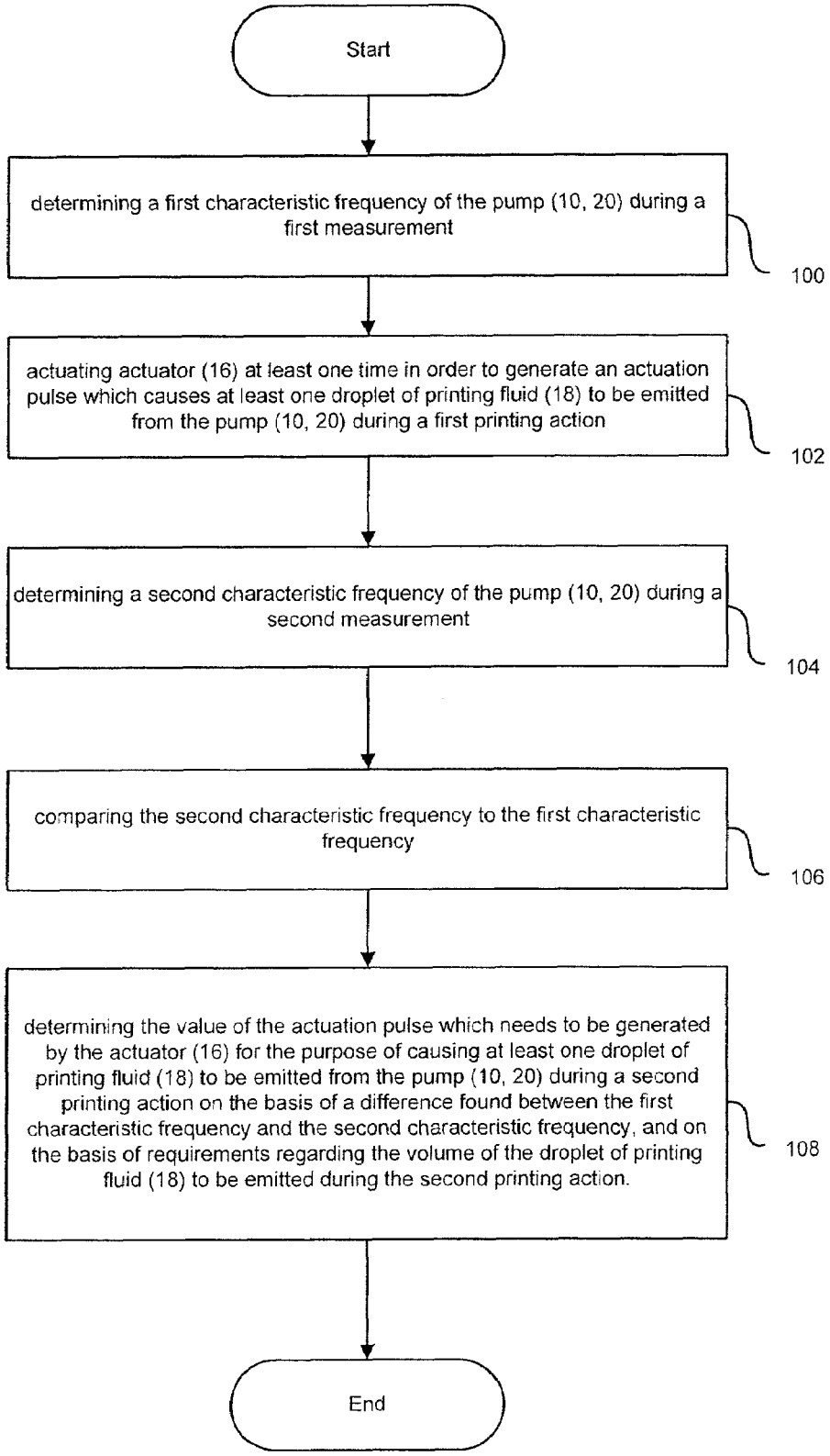

FIG. 11 shows a flowchart depicting a method for controlling volume of droplets of printing fluid.

Figure 1:
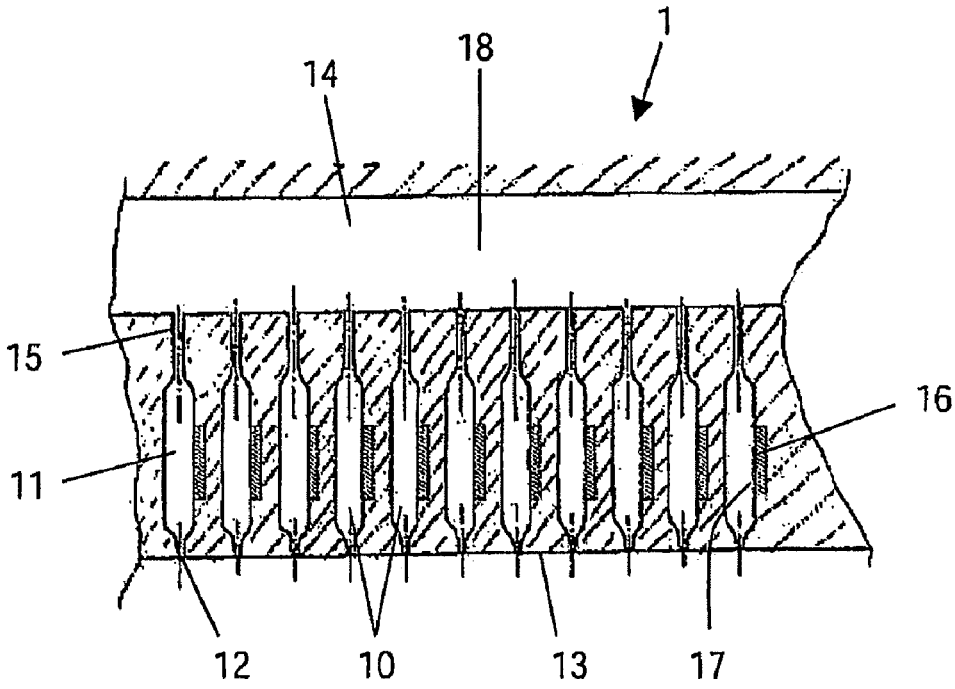
Figure 2:
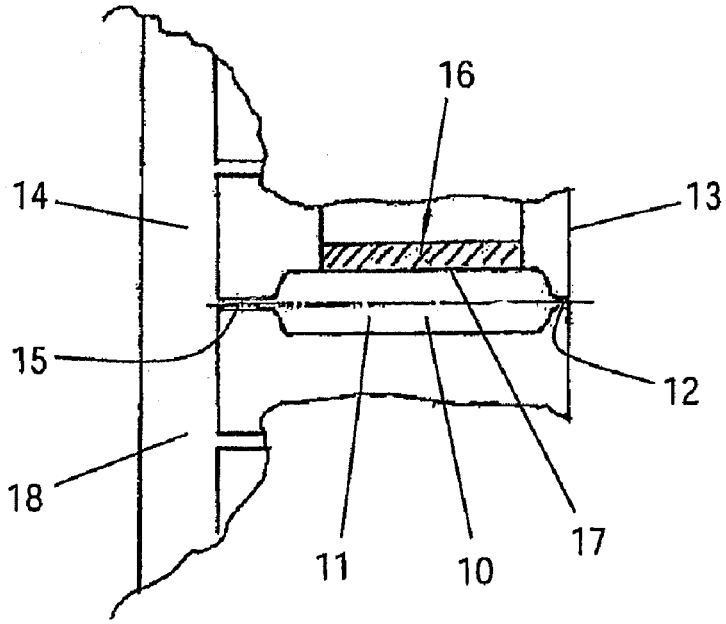
Figure 3:
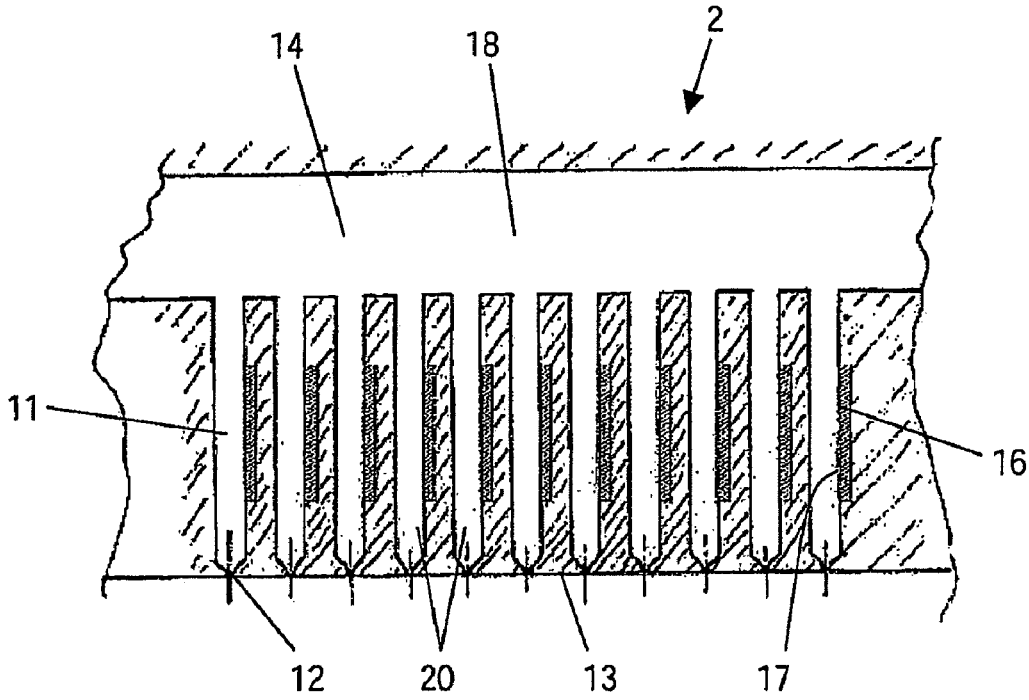
Figure 4:
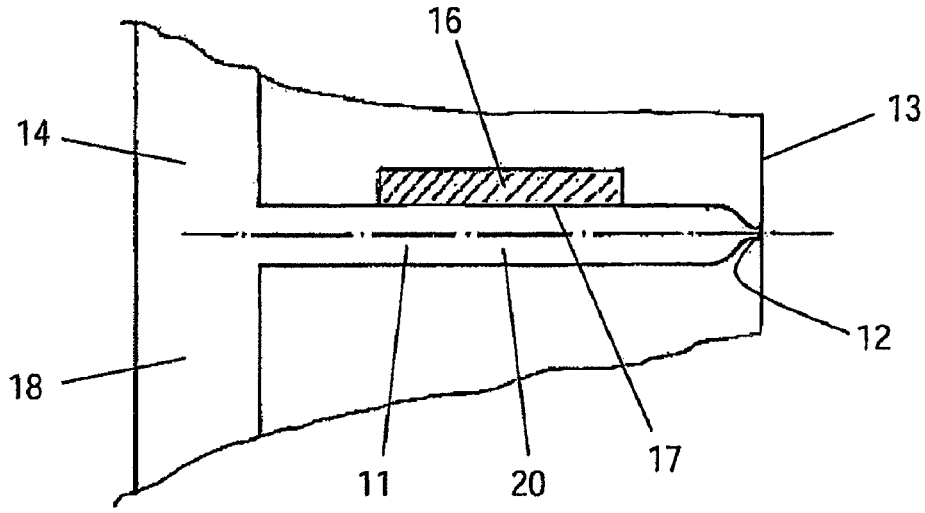

FIGS. 1-4 show piezo-electrically driven print heads, wherein FIGS. 1 and 2 show a portion of a print head 1 having Helmholtz-type ink jet pumps 10, and wherein FIGS. 3 and 4 show a portion of a print head 2 having open-end ink jet pumps 20. The print heads 1, 2 may be provided with one or more rows of inkjet pumps 10, 20.

The pumps 10, 20 comprise a pump chamber 11 for containing printing liquid that will hereinafter also be referred to as ink. At one end of the pump chamber 11, a nozzle 12 is provided, which extends between the pump chamber 11 and a nozzle front 13 of the print head 1, 2. At another end, the pump chamber 11 is connected to an ink supply channel 14. The pump chamber 11 of the pumps 10 of the print head 1 as shown in FIGS. 1 and 2 are indirectly connected to the ink supply channel 14, through a throttle 15, whereas the pump chamber 11 of the pumps 20 of the print head 2 as shown in FIGS. 3 and 4 are directly connected to the ink supply channel 14. In view of their designs, the pumps 10 of the print head 1 as shown in FIGS. 1 and 2 are referred to as Helmholtz-type ink jet pumps 10, whereas the pumps 20 of the print head 2 as shown in FIGS. 3 and 4 are referred to as open-end ink jet pumps 20.

The diameter of the nozzle 12 is substantially smaller than the diameter of the pump chamber 11. In the print head 2 as shown in FIGS. 3 and 4, the diameter of the throttle 15 is also substantially smaller than the diameter of the pump chamber 11.

Each individual pump 10, 20 is associated with an actuator 16 comprising a piezo-electric element, which actuator 16 will therefore hereinafter also be referred to as piezo-electric actuator 16. At least a portion of the wall 17 of the pump chamber 11 is flexible, so that the pump chamber 11 contracts when the actuator 16 is actuated and deforms in the direction of the pump chamber 11.

For the purpose of a printing process, the ink supply channel 14 and the pumps 10, 20 are filled with ink 18. During the printing process, the pumps 10, 20 fire ink droplets in the direction of a carrier (not shown in FIGS. 1-4) like a sheet of paper, a glass substrate or a plastic substrate, through the nozzle 12. The ink droplets are generated as a result of an actuation of the actuator 16, which causes the pump chamber 11 to contract. During the contraction of the pump chamber 11, the pressure in the pump 10, 20 is increased, as a result of which a droplet of ink 18 is released through the nozzle 12. The volume of the released droplet is roughly equal to the volume displaced by the actuator 16. The size of the droplet and the diameter of the nozzle 12 are related in the sense that the diameter of the droplet is almost equal to the diameter of the nozzle 12.

In order to achieve a high printing quality, the pumps 10, 20 are positioned at a relatively small pitch. As a consequence, the diameter of the pumps 10, 20 is small relative to the length of the pumps 10, 20, which is relatively large in order to obtain a sufficiently large volume displacement.

The speed and the diameter of the droplet are related to each other through a characteristic actuation frequency that is defined by the following equation:

$$f_{actuation} = \frac{\text{Droplet velocity}}{\text{Rayleigh break-up length}} = \frac{v_{droplet}}{\pi d_{nozzle}}$$

wherein:

$f_{actuation}$ represents the characteristic actuation frequency;

$v_{droplet}$ represents the speed of the droplet; and $d_{nozzle}$ represents the diameter of the nozzle 12.

The smaller the diameter of the nozzle 12, the smaller the size of the droplet, and the higher the actuation frequency needs to be in order to obtain a predetermined value of the speed of the droplet. For the purpose of obtaining a favourable functioning of the piezo-electrically driven print heads 1, 2, the actuation frequency should be more or less equal to the key tone frequency of the pumps 10, 20 of the print heads 1, 2. The key tone frequency is related to the design of the print heads 1, 2, more in particular the design of the pumps 10, 20.

A characteristic frequency of the pumps 10, 20 containing a fluid column of ink 18 is the Helmholtz frequency. For the Helmholtz-type ink jet pumps 10, the Helmholtz frequency is given by the following equation:

$$f_{Helmholtz} = \frac{1}{2\pi}\sqrt{\frac{K}{\rho AL}\left(\frac{A_1}{L_1} + \frac{A_2}{L_2}\right)}$$

wherein:

$f_{Helmholtz}$ represents the Helmholtz frequency;

K represents the compressibility of the ink 18, corrected for the compliance of the environment;

ρ represents the density of the ink 18;

A represents the area of the cross-section of the fluid column in the pump chamber 11;

L represents the length of the fluid column in the pump chamber 11;

$A_1$ represents the area of the cross-section of the fluid column in the nozzle 12;

$L_1$ represents the length of the fluid column in the nozzle 12;

$A_2$ represents the area of the cross-section of the fluid column in the throttle 15; and $L_2$ represents the length of the fluid column in the throttle 15.

The compressibility and the density of the ink 18 are related to the speed of sound, in the following manner:

$$K=\rho c^2$$

wherein:

c represents the speed of sound, corrected for the compliance of the environment The length of the throttle 15 is much larger than the length of the nozzle 12, while the cross-sectional dimensions of the throttle 15 and the nozzle 12 are roughly equal. Therefore, the Helmholtz frequency is mainly dependent on the dimensions of the fluid column in the nozzle 12.

In a situation in which the nozzle 12 is partly clogged, the cross-sectional area $A_1$ has become smaller. As a consequence, the Helmholtz frequency is lower.

A determining factor in relation to the length of the fluid column contained in the nozzle 12 is the meniscus under-pressure. When the under-pressure is too low, the meniscus is retracted in the nozzle 12. As a consequence, the fluid column in the nozzle 12 is shorter and the Helmholtz frequency is higher.

The compressibility of the ink 18 is very sensitive to the presence of air bubbles in the pump 10, even if these air bubbles are relatively small. Air bubbles that are as large as the droplets that need to be generated are capable of completely blocking the pump 10, as the pressure necessary for forming and firing the droplets cannot be built up in the pump 10 when such an air bubble is present. The presence of air bubbles causes the Helmholtz frequency to decrease drastically.

Figure 5:
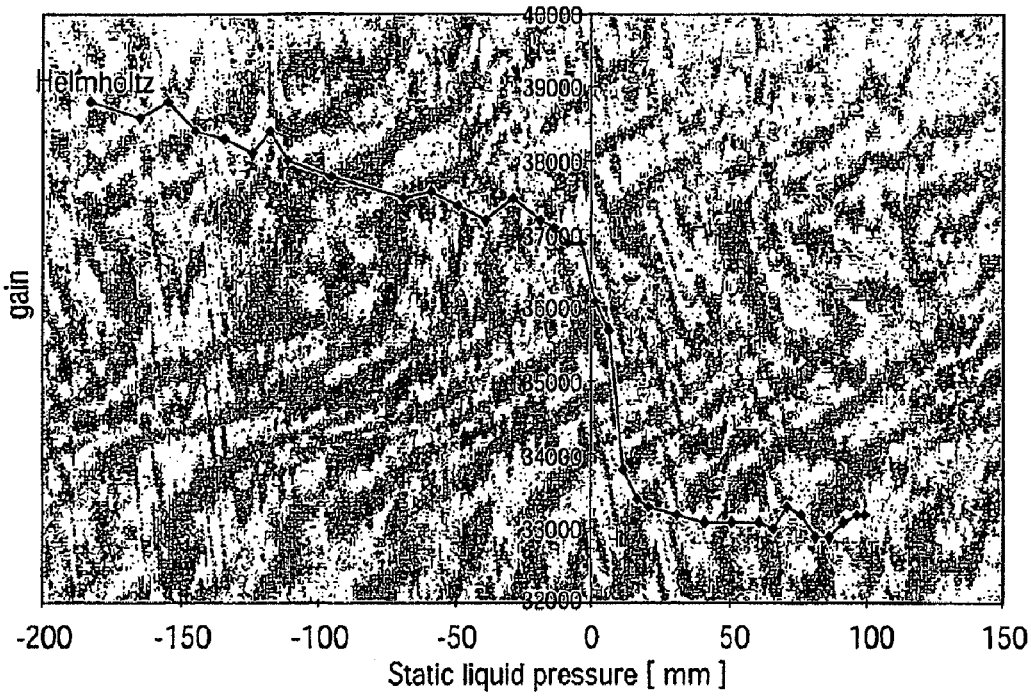
FIG. 5 shows a graphical drawing depicting a relation between a meniscus under-pressure and a measured Helmholtz frequency.

In FIG. 5, a graph is depicted, illustrating a relation between a Helmholtz frequency and the meniscus under-pressure, as obtained by a practical experiment. As already mentioned in the foregoing, the length of the fluid column in the nozzle 12 is related to the meniscus under-pressure.

The graph shows that when the absolute value of a negative pressure decreases, the Helmholtz frequency decreases as well, as a result of the fact that the length of the fluid column in the nozzle 12 increases.

Further, the graph shows that when the sign of the pressure changes, an almost stepwise drop of the Helmholtz frequency occurs. This is a result of the fact that the length of the fluid column is abruptly increased, due to wetting of the nozzle front 13.

The experimentally obtained graph proves that the Helmholtz frequency is closely related to the length of the fluid column in the nozzle 12. Furthermore, the Helmholtz frequency is very sensitive to changes in the length of the fluid column, which can be derived from the fact that the measured drop of the Helmholtz frequency is larger than 3,000 Hz. Because of the above reasons, and the fact that frequency measuring techniques are very accurate, the Helmholtz frequency can very well be used as an indicator of the state of the nozzle 12.

As the length of the fluid column in the pump chamber 11 of the pumps 10, 20 is usually large compared to its cross-sectional dimensions, wave propagation should be taken into account. Due to the occurrence of wave propagation, a spectrum of resonance frequencies is present, of which only the key tone frequency is considered in the following. For the Helmholtz-type ink jet pumps 10, the key tone frequency taking into account wave propagation follows approximately from the following transcendental equation:

$$\tan\frac{\omega L}{c} = \frac{L}{L_1}\frac{A_1}{A}\frac{1}{\left(\frac{\omega L}{c}\right)}$$

wherein:

ω represents the key tone radial frequency.

Figure 6:
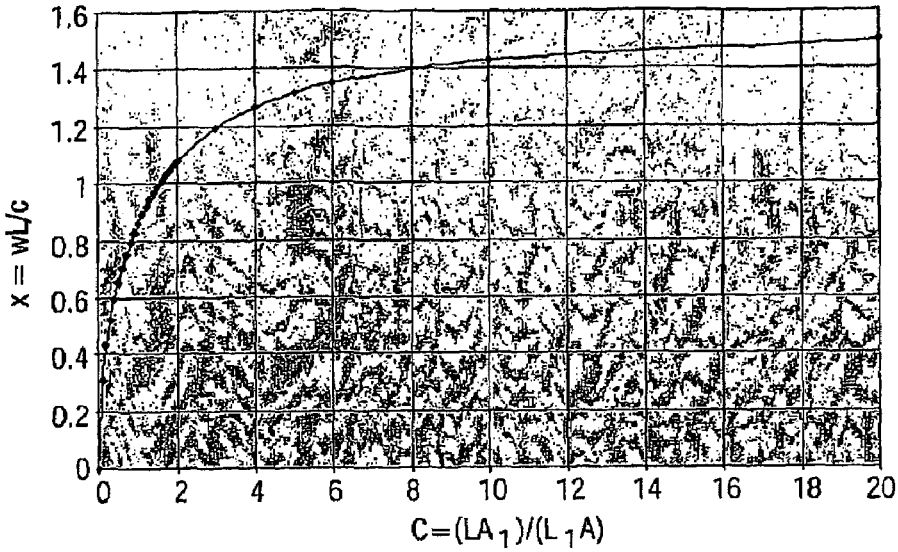
FIG. 6 shows a graphical drawing depicting a relation between dimensions of a pump, key tone frequency of the pump and speed of sound for a Helmholtz-type ink jet pump.

FIG. 6 shows a graph which can be used to solve the transcendental equation tan(x)=C/x. Along the horizontal axis of the graph, the value of $C=LA_1/L_1A$ is defined.

Along the vertical axis of the graph, the corresponding value of $x=\omega L/c$ can be found, which fulfils the transcendental equation.

When the nozzle 12 is clogged, the area of the cross-section of the fluid column in the nozzle 12 decreases, as a result of which the value of C decreases. It appears from the graph that as a result, the key tone frequency decreases as well.

Further, when the meniscus under-pressure is relatively high, the length of the fluid column in the nozzle 12 is relatively small. Consequently, the value of C is relatively high and the corresponding value of x is relatively high, which implies that the key tone frequency is relatively high.

An air bubble present in the pump chamber 11 has an enormous effect on the compressibility of the ink 18 contained in the pump chamber 11 and leads to a drastic decrease of the speed of sound and the key tone frequency.

As the key tone frequency is closely related to the dimensions of the fluid column in the Helmholtz-type ink jet pump 10, and is additionally very sensitive to air bubbles present in the pump 10, this frequency can very well be used as an indicator of the state of the pump 10, more in particular the state of the nozzle 12.

Contrary to the Helmholtz-type ink jet pumps 10, the open-end ink jet pumps 20 do not comprise a throttle 15. For that reason, and the fact that the diameter of the nozzle 12 is much smaller than the diameter of the pump chamber 11, the key tone frequency of the open-end ink jet pumps 20 is the so-called λ/4 mode frequency of a tube corrected for the presence of the nozzle 12. In this way, the following transcendental equation is obtained:

$$\tan\frac{\omega L}{c} = -\frac{A}{A_1}\frac{L_1}{L}\frac{\omega L}{c}$$

Figure 7:
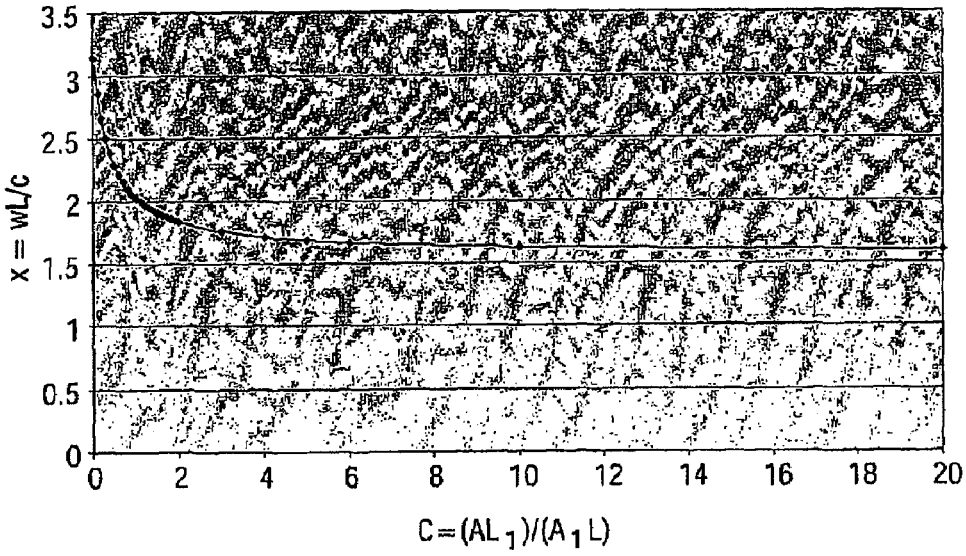
FIG. 7 shows a graphical drawing depicting a relation between dimensions of a pump, key tone frequency of the pump and speed of sound for an open-end ink jet pump.

FIG. 7 shows a graph which can be used to solve the transcendental equation tan(x)=−Cx. Along the horizontal axis of the graph, the value of $C=AL_1/A_1L$ is defined. Along the vertical axis of the graph, the corresponding value of $x=\omega L/c$ can be found, which fulfils the transcendental equation.

When the nozzle 12 is clogged, the area of the cross-section of the fluid column in the nozzle 12 decreases, as a result of which the value of C increases. It appears from the graph that as a result, the key tone frequency decreases.

Further, when the meniscus under-pressure is relatively high, the length of the fluid column in the nozzle 12 is relatively small. Consequently, the value of C is relatively small and the corresponding value of x is relatively high, which implies that the key tone frequency is relatively high.

An air bubble present in the pump chamber 11 has an enormous effect on the compressibility of the ink 18 contained in the pump chamber 11 and leads to a drastic decrease of the speed of sound and the key tone frequency.

As the key tone frequency is closely related to the dimensions of the fluid column in the open-end ink jet pump 20, and is additionally very sensitive to air bubbles present in the pump 20, this frequency can very well be used as an indicator of the state of the pump 20, more in particular the state of the nozzle 12.

Additional to the determination of a characteristic frequency of the ink jet pumps 10, 20 between two printing actions, determination of other parameters may take place. For example, the pressure rise in the pumps 10, 20 during generation of a droplet may be measured. In a pump 10, 20 containing an air bubble, the pressure rise is relatively low. Therefore, the pressure rise can be used as an indicator of the presence of enclosed air in the pumps 10, 20.

In the foregoing, a method according to the present invention for obtaining information regarding the state of ink jet pumps 10, 20 of print heads 1, 2, more in particular the state of the nozzle 12 of the pumps 10, 20, is described. This method may advantageously be applied for the purpose of controlling print heads 1, 2 that are used in the manufacturing process of PolyLED displays.

PolyLED displays comprise a multitude of rectangular LEDs that are individually controllable. The LEDs emit light when actuated by means of an electric current. Each LED comprises a stack of different layers, which are printed on a substrate. The dimensions of the LEDs are very small, in order for the human eye not to be able to discern the individual LEDs of the display. One LED may for example be 200 μm long and 67 μm wide. Suitable values of the thickness of the different layers of the LED are in the nanometre range; the thickness is for example 200 nm or even 70 nm. Consequently, the volume of ink droplets containing the material of a layer needs to be very small. Suitable values of the volume of the ink droplets are in the picolitre range.

PolyLED displays have many advantages over other types of displays. Contrary to conventional displays, which at the backside comprise a layer of phosphor elements that luminesce when actuated by electrons originating from an electron gun, there is no need for PolyLED displays to be used in combination with additional components being positioned at the backside of the display and occupying much space. In comparison with Liquid Crystal Displays, the energy consumption of PolyLED displays is relatively low, and the image is present at every possible viewing angle.

On the basis of the foregoing paragraph, it will be understood that there is a great need for reliable techniques for manufacturing PolyLED displays. Ink jet printing processes, which are part of the manufacturing process of PolyLED displays have to meet extremely high standards. For example, for one of the layers of the LEDs, the so-called Light Emitting Polymer layer, the thickness of which is 70 nm, variations in the ink dosing should not exceed a value of 2%. Furthermore, non-operation of the ink jet pumps 10, 20 is not allowed, as the PolyLED display must not contain any non-functioning LEDs. The importance of meeting the standards is even more evident when the fact that the layer is printed on a pre-patterned carrier that should not be wasted is taken into account.

The above-described method for checking the state of the pumps 10, 20 of a print head 1, 2, wherein determination of the state takes place on the basis of measurements of characteristic frequencies of the pumps 10, 20, offers the possibility of accurately controlling the volume of ink droplets. For example, if the frequency measurements point out that a nozzle 12 is somewhat clogged, the actuation pulse may be increased in order to maintain the predetermined level of droplet volume.

In case a pump 10, 20 contains an air bubble and is not able to perform its printing task, the printing process should be interrupted for the purpose of de-airing the printing head 1, 2.

In order to meet the high standards, during the printing process of a PolyLED display, the state of the pumps 10, 20 of the print head 1, 2 is advantageously checked every time before an ink droplet is fired. On the basis of a comparison of a newly measured characteristic frequency with a previously measured frequency, the value of the actuation pulse that needs to be generated by the actuator may be accurately determined, or it may appear that the printing process should be stopped and the print head 1, 2 should be subjected to maintenance or replaced. The previously measured frequency may for example have been determined during a first measurement of a fresh print head 1, 2, which may be a print head that has just been subjected to maintenance, or which may even be an entirely new print head 1, 2 which has not been used before.

In FIG. 8, a possible practical system 30 for controlling the actions of a print head 1, 2 is shown.

The controlling system 30 comprises a computer 31, which is programmed to generate information for controlling the pumps 10, 20 of the print head 1, 2 on the basis of measured characteristic frequencies of the individual pumps 10, 20 and requirements regarding the volume of the ink droplets. The measurements are performed by a measuring device 32, which is connected to the computer 31.

Further, the controlling system 30 comprises a converting device 33 for converting the serial information originating from the computer 31 into parallel information. For the purpose of actually controlling the actions of the individual actuators 16 of the print head 1, 2, a controlling device 34 is provided. The controlling device 34 is capable of individually controlling the various actuators 16 of the print head 1, 2 on the basis of the parallel information as transmitted by the converting device 33.

Advantageously, use is made of the fact that a piezo-electric element can function simultaneously as an actuator and as a sensor. In this way, the characteristic frequency can be measured continuously, so that it can be assured that every printing action meets the requirements. A common four-point measuring technique may be applied, wherein the actuating and sensing actions may be performed at the same time.

It is not necessary to use the entire piezo-electric element as a sensor. Instead, the piezo-electric element can be split into two portions, wherein one portion is used for actuating the pump 10, 20, and wherein another portion is used for measuring the characteristic frequency of the pump 10, 20.

In FIG. 9, a possible practical system 40 for measuring a characteristic frequency of a single ink jet pump 10, 20 is shown.

The measuring system 40 comprises an oscillator circuit 41, which is arranged such as to act on the pump 10, 20. The oscillator circuit 41 starts to resonate at a suitable frequency, for example the key tone frequency. The voltage swing of the oscillation is only a few Volts, so that the pump 10, 20 does not release any ink 18.

The oscillator circuit 41 is constructed such as to output a frequency dependent voltage. An amplifier circuit 42 is provided for amplifying and buffering the voltage output by the oscillator circuit 41. Further, an analog to digital converter 45 of a suitable resolution is provided for converting the analogue amplified voltage into a digital output word that is representative of the characteristic frequency at which the pump 10, 20 is resonating.

In FIG. 10, a possible practical system 50 for measuring a characteristic frequency of a number of ink jet pumps 10, 20 is shown.

In the shown measuring system 50, each pump 10, 20 is connected to an oscillator circuit 41, and each oscillator circuit 41 is followed by an amplifier circuit 42. All outputs 43 of the amplifier circuits 42 are connected to a single selection circuit 44.

By applying a digital selection word to the selection circuit 44, the amplified voltage output by one pump 10, 20 is transmitted to an analog to digital converter 45. The converter 45 outputs a digital output word that is representative of the characteristic frequency at which the pump 10, 20 concerned is resonating.

As stated in the foregoing, when an air bubble gets entrapped in the pump 10, 20, the functioning of the pump 10, 20 is affected to a large extent. The air bubble may even be large enough to prevent the pump 10, 20 from releasing ink 18. Total failure of the pump 10, 20 may also be caused by other factors, for example extreme clogging of the nozzle 12.

In the context of manufacturing PolyLED displays, every time when complete failure of a pump 10, 20 occurs, the printing process needs to be stopped. This is bothersome, as an interruption of the manufacturing process costs time and money, but this is necessary in order to meet the high standards.

In order to solve the above-sketched problem, according to an important aspect of the present invention, the print heads 1, 2 comprise at least two rows of pumps 10, 20, wherein the state of the pumps 10, 20 of the rows is continuously checked according to the method as described in the foregoing.

If at a certain stage of the printing process, a certain pump 10, 20 is not able to release ink 18 any more, the measured characteristic frequency will reveal this state of the pump 10, 20 concerned. In such a situation, the pump 10, 20 at a corresponding position in another row may be used to perform the printing action which should actually be performed by the pump 10, 20 that has fallen out of action. In this way, the time needed for a single printing action may increase, but interruption of the printing process is prevented. Since there is no correlation between the failure mechanisms of the different rows of the print head 1, 2, it is most unlikely that pumps 10, 20 at corresponding positions in different rows fail simultaneously or shortly after each other. Therefore, by having the dosing operation of a non-operating pump 10, 20 of a row taken over by another pump 10, 20 of another row an enormous increase in reliability is obtained. It will be understood that it is important that all areas of a carrier which need to be covered with ink 18 can be reached by at least two individual rows of pumps 10, 20.

The individual rows of pumps 10, 20 may be controlled such that all pumps 10, 20 are normally involved in the printing process. For example, a pump 10, 20 of a first row may normally fire two droplets of ink 18 in the direction of a certain area of a carrier, whereas a pump 10, 20 of a following row may somewhat later also normally fire two droplets of ink 18 in the direction of the same area. In case the pump 10, 20 of the first row fails, the following pump 10, 20 is controlled such as to fire four droplets of ink 18 instead of two droplets of ink 18 in the direction of each area that needs to be covered with ink 18 during the printing process. It is alternatively possible that the pump 10, 20 of the following row fails, and that the pump 10, 20 of the first row is controlled such as to fire four droplets of ink 18 in the direction of each area that needs to be covered with ink 18 during the printing process.

According to another option for controlling the individual rows of pumps 10, 20, only the pumps 10, 20 of a first row are normally involved in the printing process, wherein the pumps 10, 20 of a following row are not used until the function of at least one pump 10, 20 of the first row needs to be taken over.

It will be understood that the same effects as described in the foregoing paragraphs are obtained when two or more print heads 1, 2 comprising a single row of pumps 10, 20 are applied. Preferably, in such a case, the individual print heads 1, 2 follow the same path with respect to the carrier during the printing process, wherein one print head 1, 2 follows another print head 1, 2 at a close distance.

Further, it will be understood that it is not necessary to apply two rows of pumps 10, 20 in order for one pump 10, 20 to be able to take over the function of another pump 10, 20. Even if one single row of pumps 10, 20 is applied, pumps 10, 20 may take over each other's function when the row is movable in the direction in which it extends.

It is not necessary that the function of a pump 10, 20 that has fallen out of action is taken over by only one other pump 10, 20; it is also possible that two or more other pumps 10, 20 are used to ensure that the printing process can be continued while still meeting the requirements. In the example of the pumps 10, 20 normally firing two ink droplets, the function of a pump 10, 20 that has fallen out of action may be performed by two pumps 10, 20, wherein each of the two pumps 10, 20 is controlled such as to fire three ink droplets instead of two ink droplets. However, in such a case, both pumps 10, 20 need to be brought to positions where the pump 10, 20 that has dropped out would have performed printing actions.

It will be clear to a person skilled in the art that the scope of the present invention is not limited to the examples discussed in the foregoing, but that several amendments and modifications thereof are possible without deviating from the scope of the present invention as defined in the attached claims.

In the foregoing, a method according to the present invention for obtaining information regarding the state of ink jet pumps 10, 20 of print heads 1, 2, more in particular the state of the nozzle 12 of the pumps 10, 20, is described. According to an important aspect of the method according to the present invention, a characteristic frequency of the pumps 10, 20 containing a fluid column of ink 18 is determined. The characteristic frequency provides information concerning the resonance characteristics of the pumps 10, 20, which are directly related to the geometry of the pumps 10, 20. Therefore, determination of the characteristic frequency of the pumps 10, 20 offers the possibility of detecting changes in the nozzle 12 of the pumps 10, 20.

In case of a change being detected, the consequences of the change are determined by its magnitude and requirements regarding the volume of the ink droplets to be emitted. When the change in the characteristic frequency is relatively small and the volume of the ink droplets needs to be maintained at a constant level, the value of the actuation pulse generated by the actuator 16 acting on the pump 10, 20 concerned needs to be adjusted. When the change in the characteristic frequency is relatively large and brings about a decrease of the characteristic frequency, the conclusion may be that air is present in the pump 10, 20 concerned. If that is the case, the function of the pump 10, 20 needs to be taken over by at least one other pump 10, 20, or the print head 1, 2 needs to be flushed and de-aired.

The determined characteristic frequencies may for example be Helmholtz frequencies or key tone frequencies. Such frequencies can be measured in an accurate and reliable manner, also due to the fact that these frequencies are inherent characteristics of the pumps 10, 20 containing ink 18, which are not dependent for example on whether the pumps 10, 20 are releasing ink 18 or not.

An important advantage of continuously monitoring the characteristic frequencies of all the pumps 10, 20 of a print head 1, 2 is that the printing process as performed by the print head 1, 2 can be performed in a very accurate manner. Another advantage is that a well-founded decision may be taken regarding replacement of the print head 1, 2.

FIG. 11 shows a flowchart depicting a method for controlling volume of droplets of printing fluid according to the present invention. As stated in the foregoing, the present invention provides the method for accurately controlling the volume of ink droplets emitted from a print head (1, 2). Specifically, the method for controlling the volume of droplets of printing fluid (18) emitted from a print head (1, 2) during a printing process includes; the print head (1, 2) having: at least one pump (10, 20) having an inlet for taking in the printing fluid (18), a pump chamber (11) for containing the printing fluid (18) and an outlet for letting out printing fluid (18); and an actuator (16) for generating actuation pulses acting on the printing fluid (18) in the pump (10, 20). The method also has the following steps: Step (100): determining a first characteristic frequency of the pump (10, 20) during a first measurement; Step (102): actuating the actuator (16) at least one time in order to generate an actuation pulse which causes at least one droplet of printing fluid (18 ) to be emitted from the pump (10, 20) during a first printing action; Step (104): determining a second characteristic frequency of the pump (10, 20) during a second measurement; Step (106): comparing the second characteristic frequency to the first characteristic frequency; and Step (108): determining the value of the actuation pulse which needs to be generated by the actuator (16) for the purpose of causing at least one droplet of printing fluid (18) to be emitted from the pump (10, 20) during a second printing action on the basis of a difference found between the first characteristic frequency and the second characteristic frequency, and on the basis of requirements regarding the volume of the droplet of printing fluid (18) to be emitted during the second printing action.

The invention claimed is:

1. A method for controlling volume of droplets of printing fluid (18) emitted from a print head (1,2) during a printing process; said print head (1,2) having: at least one pump (10, 20) having an inlet for taking in the printing fluid (18), a pump chamber (11) for containing the printing fluid (18) and an outlet for letting out printing fluid (18); and an actuator (16) for generating actuation pulses acting on the printing fluid (18) in the pump (10,20); said method comprising the following steps:

determining a first characteristic frequency of the pump (10,20) during a first measurement;

actuating the actuator (16) at least one time in order to generate an actuation pulse which causes at least one droplet of printing fluid (18) to be emitted from the pump (10,20) during a first printing action;

determining a second characteristic frequency of the pump (10,20) during a second measurement;

comparing the second characteristic frequency to the first characteristic frequency; and determining the value of the actuation pulse which needs to be generated by the actuator (16) for the purpose of causing at least one droplet of printing fluid (18) to be emitted from the pump (10,20) during a second printing action on the basis of a difference found between the first characteristic frequency and the second characteristic frequency, and on the basis of requirements regarding the volume of droplets of printing fluid (18) to be emitted during the second printing action.

2. The controlling method according to claim 1, wherein actuation of the actuator (16) is alternated with determination of the characteristic frequency of the pump (10,20) associated with the actuator (16) throughout the printing process.

3. The controlling method according to claim 1, wherein the requirements regarding the volume of droplets of printing fluid (18) to be emitted during the second printing action include maintaining a level of the volume of droplets of printing fluid (18) emitted during the first printing action.

4. The controlling method according to claim 1, wherein the pump is a Helmholtz-type ink jet pump (10), and wherein each of the first and second characteristic frequencies comprises a Helmholtz frequency or a key tone frequency of the pump (10).

5. The controlling method according to claim 1, wherein the pump is an open-end ink jet pump (20), and wherein each of the first and second characteristic frequencies comprises a key tone frequency of the pump (20).

6. The controlling method according to claim 1, wherein the first measurement is performed on a fresh print head (1,2).

7. The controlling method according to claim 1, wherein the actuator (16) comprises a piezo-electric element, wherein the piezo-electric element is used as a frequency sensor for determining the characteristic frequency of the pump (10,20).

8. The controlling method according to claim 1, wherein the printing process as performed by the pump (10,20) is stopped in case it appears that the determined value of the actuation pulse which needs to be generated by the actuator (16) for the purpose of causing at least one droplet of printing fluid (18) to be emitted from the pump (10,20) during a second printing action cannot be set.

9. The controlling method according to claim 8, wherein the print head (1,2) comprises at least two pumps (10,20), and wherein at least one of the pumps (10, 20) is controlled to take over the function of another of the pumps (10,20) in case the printing process as performed by the latter has been stopped.

* * * * *